US010580353B2

(12) United States Patent
Tripathi

(10) Patent No.: US 10,580,353 B2
(45) **Date of Patent: *Mar. 3, 2020**

(54) NIGHT VISION COMPATIBLE DISPLAY

(71) Applicant: L3 Technologies, Inc., New York, NY (US)

(72) Inventor: Sanjay Tripathi, San Diego, CA (US)

(73) Assignee: L-3 COMMUNICATIONS CORPORATION, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/925,480

(22) Filed: Mar. 19, 2018

(65) Prior Publication Data

US 2018/0218671 A1 Aug. 2, 2018

Related U.S. Application Data

(63) Continuation of application No. 15/178,743, filed on Jun. 10, 2016, now Pat. No. 9,922,593, which is a continuation of application No. 14/469,273, filed on Aug. 26, 2014, now Pat. No. 9,390,650.

(60) Provisional application No. 61/872,016, filed on Aug. 30, 2013.

(51) Int. Cl.
*G09G 3/3208* (2016.01)

(52) U.S. Cl.
CPC ... *G09G 3/3208* (2013.01); *G09G 2300/0452* (2013.01); *G09G 2320/0626* (2013.01); *G09G 2320/0666* (2013.01); *G09G 2360/144* (2013.01); *G09G 2380/12* (2013.01)

(58) Field of Classification Search
CPC ..... G09G 3/3208; G09G 2320/0626; G09G 2320/0666; G09G 2300/0439; G09G 2300/0452; G09G 2360/144; G09G 2380/12
See application file for complete search history.

(56) References Cited

U.S. PATENT DOCUMENTS

| | | | | |
|---|---|---|---|---|
| 7,224,327 | B2 * | 5/2007 | Wammes | G02B 23/125 345/32 |
| 8,310,424 | B2 * | 11/2012 | Irie | G02F 1/13306 345/204 |
| 8,400,587 | B2 * | 3/2013 | Woo | G02F 1/1323 349/106 |
| 9,390,650 | B2 * | 7/2016 | Tripathi | G09G 3/3208 |
| 9,922,593 | B2 * | 3/2018 | Tripathi | G09G 3/3208 |
| 2006/0103615 | A1 * | 5/2006 | Shih | G09G 3/3607 345/88 |
| 2006/0158467 | A1 * | 7/2006 | Larson | G02F 1/134309 345/694 |

(Continued)

*Primary Examiner* — Tom V Sheng
(74) *Attorney, Agent, or Firm* — Dickinson Wright PLLC

(57) ABSTRACT

The disclosure relates to an emissive display configured to operate in a day mode and a night mode. The emissive display comprises a day pixel configured to operate in the day mode. The emissive display also comprises a night pixel configured to operate in the night mode, wherein the night pixel is not operational in the day mode. The emissive display also comprises a common pixel configured to operate in both the day mode and the night mode. The emissive display also comprises a detector configured to selectively change an operating mode of the display between the day mode and the night mode based on a detected indication.

23 Claims, 4 Drawing Sheets

(56) References Cited

U.S. PATENT DOCUMENTS

| | | | | |
|---|---|---|---|---|
| 2006/0221030 | A1* | 10/2006 | Shih | G09G 3/3611 345/88 |
| 2007/0075935 | A1* | 4/2007 | Mesmer | G09G 3/3233 345/76 |
| 2007/0171623 | A1* | 7/2007 | Zagar | B60K 35/00 362/23.12 |
| 2007/0176862 | A1* | 8/2007 | Kurt | G09G 3/2092 345/82 |
| 2008/0309594 | A1* | 12/2008 | Mas | G09G 3/3208 345/76 |
| 2009/0128458 | A1* | 5/2009 | Kim | G09G 3/3233 345/76 |
| 2011/0148832 | A1* | 6/2011 | Nie | G09G 3/3648 345/207 |
| 2011/0221792 | A1* | 9/2011 | Maeda | G09G 3/3607 345/690 |
| 2012/0086743 | A1* | 4/2012 | Shiomi | G02F 1/136213 345/694 |
| 2012/0105517 | A1* | 5/2012 | Yang | G09G 3/003 345/694 |
| 2012/0268357 | A1* | 10/2012 | Shih | G09G 3/3607 345/88 |
| 2012/0287147 | A1* | 11/2012 | Brown Elliott | G09G 5/02 345/593 |
| 2013/0027279 | A1* | 1/2013 | Peacock | G06F 3/1446 345/1.3 |
| 2013/0048858 | A1* | 2/2013 | Gertsenshteyn | H01L 27/1465 250/338.4 |
| 2015/0009194 | A1* | 1/2015 | Kim | G09G 3/3233 345/211 |

* cited by examiner

NIGHT VISION COMPATIBLE DISPLAY

CROSS-REFERENCE TO RELATED APPLICATION

The present application is a continuation of and claims priority to application Ser. No. 15/178,743, filed Jun. 10, 2016, which is a continuation of and claims priority to application Ser. No. 14/469,273, filed on Aug. 26, 2015, which claims priority to Application Ser. No. 61/872,016, filed on Aug. 30, 2013, the contents of all of the foregoing being incorporated by reference in their entirety.

BACKGROUND

OLEDs are light-emitting diodes (LED) that emit with an emissive electro-luminescent layer composed of a film comprising an organic compound. The organic compound emits light in response to an electro-current stimuli running across the film. OLEDs can be made from small molecules or polymer sources. One of the advantages of an OLED display over other display formats is that OLED displays produce a lighted display without the need for a backlight. This allows for the production of deeper black levels of luminance on a thinner and lighter display screen than a corresponding liquid crystal display (LCD) screen. These deeper black levels allow for a higher contrast ratio on an OLED screen than a corresponding LCD screen in low ambient light conditions.

An OLED display 30 is shown in FIG. 1. An exemplary OLED display 30 consists of several parts including, a substrate 10, an anode 12, a plurality of organic layers 14, at least one conducting layer 16, at least one emissive layer 18, and a cathode 20. The substrate 10 may be plastic or glass that supports the other layers. The anode 12 removes electrons when a current is run through the device, whereas the cathode 20 injects electrons into the OLED display 30 when a current flows through the device. The organic layers 14 may be made of organic molecules or polymers depending on the type of OLED and are frequently deposited by vacuum deposition or vacuum thermalization or organic vapor phase deposition. However, inkjet printing can be used for depositing OLEDs onto the substrate 10. In a typical OLED, such as OLED display 30 the cathode 20 is stacked on top of the emissive layer 18 which is stacked on top of the conductive layer 16 which is stacked on top of the anode 12 which is stacked on top of the substrate 10.

The benefits of OLED displays over LCD displays are known. OLED displays are lighter weight than their LCD counterparts, can provide greater flexibility in the display, can have a wider viewing angle and a faster response time than corresponding LCD displays. Additionally, as described above, OLED displays are preferred in low-light conditions as OLED displays have a higher contrast ratio than their corresponding LCD displays. Additionally, OLEDs do not require a backlight which provides the thinner and lighter display than a corresponding LCD. At its most basic, an OLED display comprises a single organic layer between the anode and cathode. However, an OLED display having multiple layers of organic material is another possibility. Further, one of the most common OLED display configurations is a bilayer OLED comprising a conductive and emissive layer as described above.

OLED displays can be created using small molecules or polymers. Additionally, they can be created using a passive matrix (PMOLED) or an active matrix (AMOLED) addressing scheme. Small molecule based OLEDs are frequently created using vacuum deposition whereas polymer LEDs are frequently created using spin coating or ink jet printing. Additionally, while OLEDs have been described with the cathode on top of the stacking structure, inverted OLEDs, which provide the anode on the top of the stacking structure, are also known.

Transparent OLEDs are also known. Transparent OLEDs comprise transparent or semi-transparent contacts on both sides of an OLED device. These transparent or semi-transparent contacts allow displays to be made to be either top or bottom emitting. Top emitting OLEDs can have greatly improved contrast making it easier to view displays in direct sunlight.

SUMMARY

The disclosure relates to an emissive display configured to operate in a day mode and a night mode. The emissive display comprises a day pixel configured to operate in the day mode. The emissive display also comprises a night pixel configured to operate in the night mode, wherein the night pixel is not operational in the day mode. The emissive display also comprises a common pixel configured to operate in both the day mode and the night mode. The emissive display also comprises a detector configured to selectively change an operating mode of the display between the day mode and the night mode based on a detected indication.

DETAILED DESCRIPTION OF ILLUSTRATIVE EMBODIMENTS

While embodiments of the present invention will be described using a pixel architecture that places sub-pixels next to each other, it is also known that similar architectures can be created using stacked OLEDs wherein the sub-pixels are stacked on top of each other leading to increases in gamut and color depth and reducing pixel gap.

LCD displays are known in night vision technology as a possible technology choice for a night vision display. In an LCD display, in order to meet night vision requirements, the backlight of the LCD is filtered before it allows light to be transmitted to the screen of the display. In order to preserve a color gamut under daylight conditions, the LCD can also use two different backlights, one for daylight conditions and one for night conditions. Thus, the transition of an LCD display between a day mode and a night mode is dependent on alterations to the backlight, either through a filter or substituting the backlight altogether. This conventional approach with LCDs is not compatible with OLEDs because OLEDs produce the color viewed on an OLED display without a backlight, therefore neither the filtering approach nor the substitution approach will work on an OLED display.

One way to achieve night vision compatibility with an OLED display would be to cover the entire display with Night Vision (NVIS) filter glass. However, this is not desirable as NVIS filter glass has a low transmission, poor color gamut in daylight mode and is expensive. An alternative solution would be to create new pixel arrangement for an OLED display to make the OLED display compatible with night vision devices without sacrificing colors when the night vision functionality of the device is not necessary.

While the pixel arrangement solution presented below is presented in the context of OLED displays, it is to be understood that this pixel arrangement could also be implemented on an LCD display or any other appropriate display that relies on the arrangement of subpixels. For example, while embodiments of the present invention are described with respect to an OLED display, these embodiments could also be implemented on electroluminescent mode quantum dots or micro-LEDs (micro light emitting diodes) or any other emissive display technology where individual subpixel can be tuned to a particular color or wavelength. Additionally, while the subpixel arrangement is described in the context of day and night modes of an night-vision compatible display, the subpixel arrangement could also be implemented in displays for other purposes as well.

Figure 1:
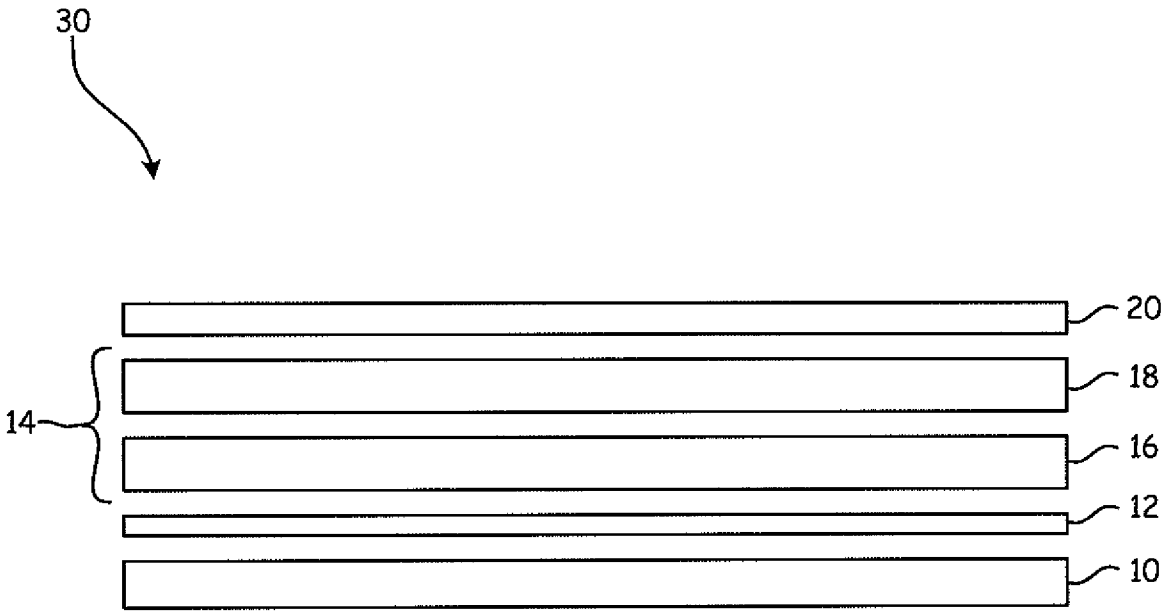
FIG. 1 is an exploded view of an OLED with which embodiments of the present invention are useful.
Figure 2:
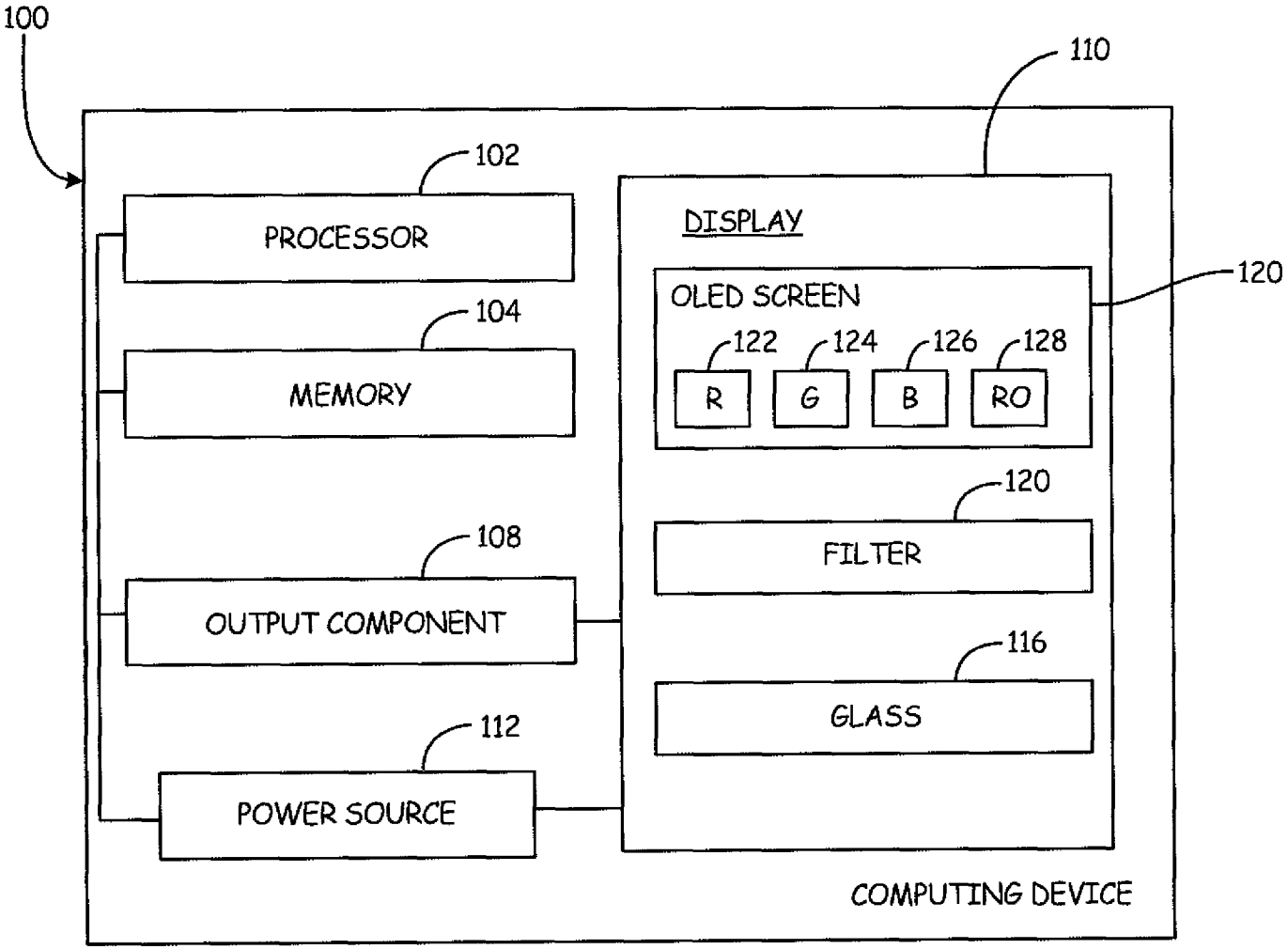
FIG. 2 is a diagrammatic view of a computing device with a display with which embodiments of the present invention are useful.

FIG. 2 is a diagrammatic view of a computing device with a display with which embodiments of the present invention are useful. FIG. 2 shows a schematic of an exemplary computing device with an OLED display that may be configured to be compatible with night vision requirements. In one example, the computing device 100 includes a processor 102, a memory 104, an output component 108, a power source 112, and a display 110.

The power source 112, in one embodiment, powers both the processor 102 and the display 110. However, in another embodiment, the display 110 could also have an independent power source from the computing device 100. In one embodiment, both the computing device 100 and the display 110 rely on a contained power source 112, such that the computing device 100 does not need to be connected to an external power supply, allowing for ease of movement and installation of the computing device 100 with display 110.

The display 110 comprises an OLED screen 120 in one embodiment. The display 110 may also comprise a filter 114, and may comprise a screen cover 116. In one embodiment, the screen cover 116 is a glass cover, however, in another embodiment, the screen cover 116 could also be composed of a transparent or semi-transparent plastic. The OLED screen 120 is comprised of a plurality of pixels wherein those pixels include subpixels of the following four colors: red 122, green 124, blue 126, and night-vision 128. Depending on the selection of a daylight mode or a night mode, not all of these sub-pixels will be used to generate a color of the display 110. In one embodiment, only three of the four sub-pixels are used in any given mode. In one embodiment, the subpixels are arranged in a regular, repeating configuration across the OLED screen.

As shown in FIGS. 3A-3D, a quad-pixel arrangement of the red 122, green 124, blue 126, and night-vision 128 sub-pixels are used in an exemplary OLED screen 120. However, in another embodiment, the quad-pixel arrangement could be implemented on an LCD screen or LED screen. Further, the pixels could be implemented as micro-LEDs in an additional embodiment. In a further embodiment, the quad-pixel arrangement could be composed of sub-pixels comprising quantum dots in an electroluminescent mode. In a further embodiment, the quad-pixel arrangement could be composed of sub-pixels comprising screen with tunable subpixels in an electroluminescent mode. This quad-pixel arrangement implemented on an exemplary OLED screen allows for a distinction between daylight and night time mode without the need for an additional night vision filter. Several different arrangements of the four pixels are possible, but two possibilities are shown in FIGS. 3A-3D. A 1×4 structure is shown, where the four subpixels are arranged and repeated linearly. A 2×2 structure is also shown, where the four subpixels are arranged in a 2×2 square that repeats linearly. While the subpixels red 122, green 124, blue 126 and night-vision 128 are shown in a particular order and arrangement in FIGS. 3A-3D, it is to be understood that the order of the four colors within either the 1×4 or the 2×2 arrangement could be different, with any permutation of the ordering as a possibility.

Organic material appropriate for the creation of the red 122, green 124 and blue 126 subpixels are known as these three colors are often used in tri-color and quad-color subpixel arrangements in LCD and OLED screens. The organic material comprising the night-vision pixel should be selected such that there are no significant emissions in the infrared (IR) range that can be detected by a night vision device. One example of an appropriate night-vision pixel selection would be a red-orange subpixel. The two exemplary quad-pixel arrangements are shown in FIGS. 3A and 3B as well as FIGS. 3C and 3D exemplifying the day and night modes with either the 1×4 or the 2×2 arrangements.

Figure 3B:
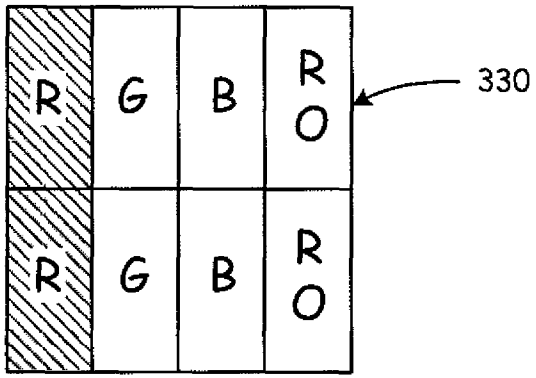
FIGS. 3A and 3B illustrate an exemplary daylight operating mode of an OLED display in accordance with one embodiment.
Figure 3D:
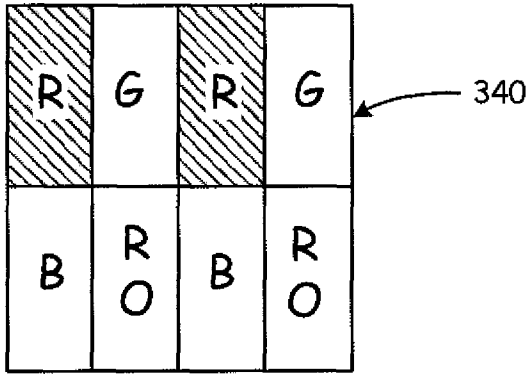
FIGS. 3C and 3D illustrate an exemplary night operating mode of an OLED display in accordance with one embodiment.
Figure 3A:
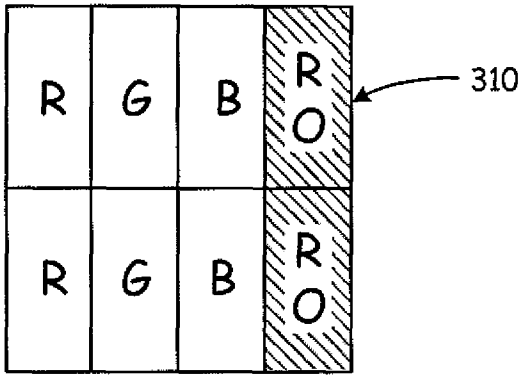
Figure 3C:
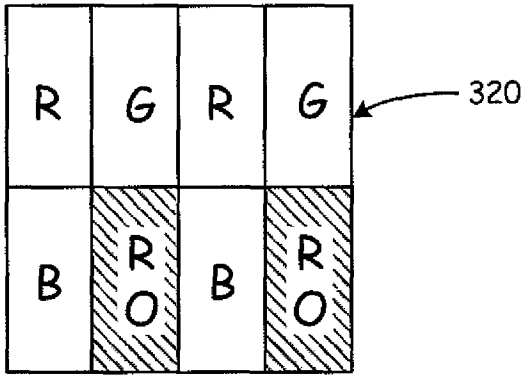

As shown in FIGS. 3A and 3B, in the daylight mode, pixels comprising the colors of red 122, green 124 and blue 126 are used to provide color to the OLED display. In the daylight mode, the night-vision 128 sub-pixel is not necessary and thus may not be used to produce color on the display in one embodiment. In contrast, in a night time mode, the green 124, blue 126 and night-vision 128 sub-pixels are used to produce light and the red sub-pixels 122 are not used. FIGS. 3A-3D only show illustratively either two lines or two squares of pixels. However, it is envisioned that these patterns would repeat vertically and horizontally across the entirety of an OLED screen 120, in one embodiment.

Figure 4:
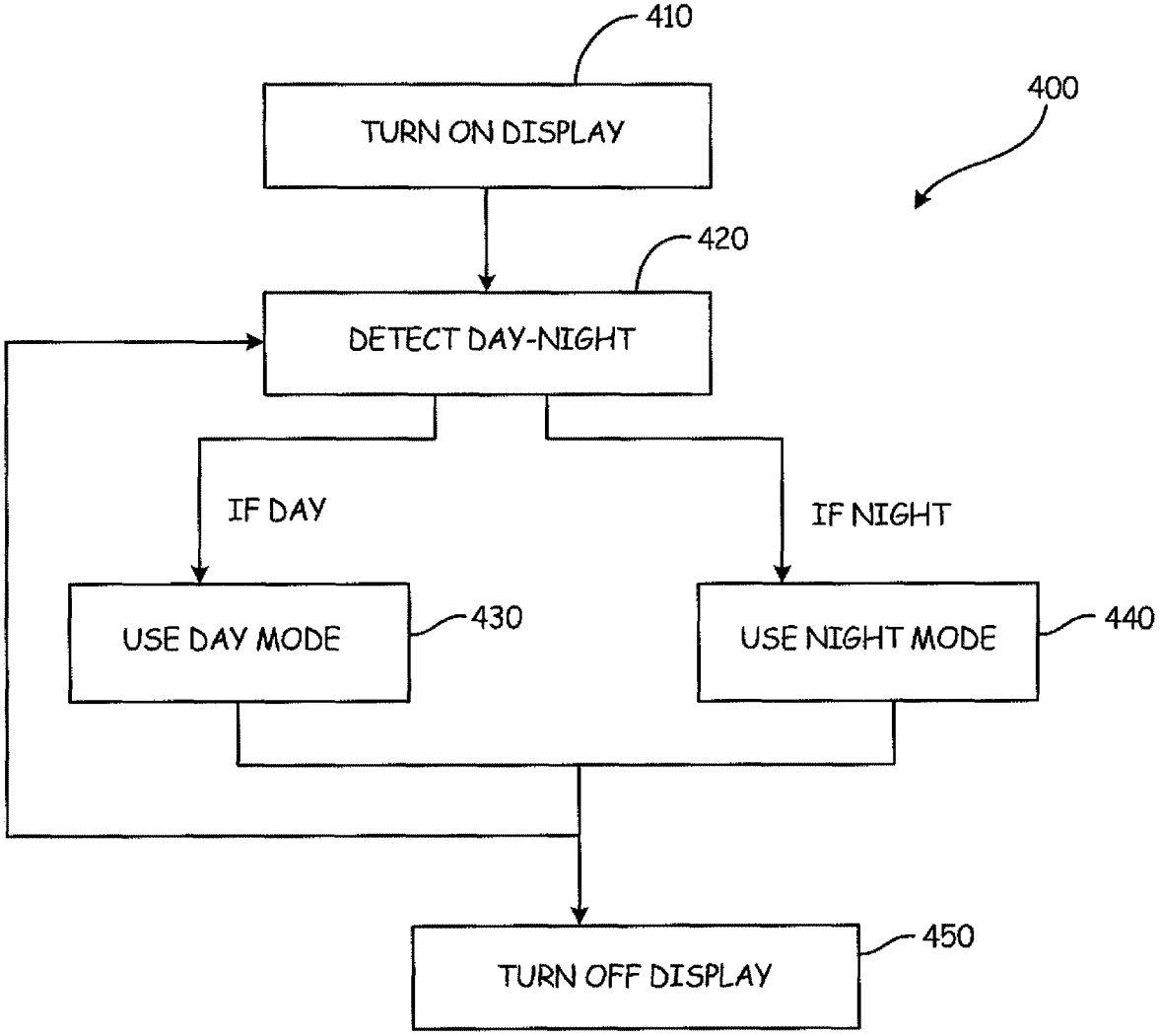
FIG. 4 illustrates an exemplary method of a day to night transition in accordance with one embodiment.

FIG. 4 illustrates a method 400 wherein a single display can be used for both day mode and night mode, as exemplified in FIGS. 2A-2D, with either the red 122 activated for day mode or the night-vision 128 activated for night mode. At block 410, the display is turned on wherein power from the power supply 112 is provided to display 110. At block 420, in one embodiment, the display automatically detects a need for day or night mode, for example by measuring ambient light delivered to the display. However, in another embodiment, block 420 may comprise a user indicating to the display a selection of day or night mode.

Upon detecting that daylight mode is required, the device, as noted in block 430, will use the day mode, for example using the configuration of pixels shown in FIG. 3A or 3B wherein sub-pixels of colors red 122, green 124 and blue 126 are used to provide color to the display. Alternatively, if night mode is detected, as shown in block 440, the display will use the night mode configuration either shown in FIG. 3C or 3D to provide color to the display using green 124, blue 126 and night-vision 128 sub-pixels. Once the requisite mode has been either detected or selected by a user, the display may continue to use that mode until the display either detects by itself or a user initiates a need to detect a switch between a day or a night mode as indicated in FIG. 4 by the arrow that returns the method back to block 420. At the end of a particular use session of the display, the display may be turned off as indicated in block 450. In one embodiment, the display will periodically run a check for a day or night mode. For example, the display may be calibrated with an internal clock and check every minute for a need to switch. Alternatively, the display may contain a detector that detects ambient light conditions continuously and initiates a switch between day and night mode based on a minimum threshold for ambient light been met. However, in another embodiment, the display does not comprise a detector and relies on a user input to switch between day and night modes.

Although the present invention has been described with reference to preferred embodiments, workers skilled in the art will recognize that changes may be made in form and detail without departing from the spirit and scope of the invention.

What is claimed is:

1. An emissive display configured to operate in a day mode and a night mode, the display comprising:

a day pixel configured to operate in the day mode;

a night pixel configured to operate in the night mode, wherein the night pixel is not operational in the day mode;

a common pixel configured to operate in both the day mode and the night mode; and a detector configured to selectively change an operating mode of the emissive display between the day mode and the night mode based on a detected indication;

wherein the common pixel is selected from the group consisting of a green pixel and a blue pixel.

2. The emissive display of claim 1, wherein the display is an electroluminescent display.

3. The emissive display of claim 1, wherein the display comprises an OLED display.

4. The emissive display of claim 1, wherein the display comprises an LCD display.

5. The emissive display of claim 1, wherein the display comprises an quantum dot display.

6. The emissive display of claim 1, wherein the display comprises a LED display.

7. The emissive display of claim 1, wherein the display comprises a micro-LED display.

8. The emissive display of claim 1, wherein the detected indication comprises a communication from a remote processor.

9. The emissive display of claim 1, wherein the detected indication comprises a detected ambient light condition.

10. The emissive display of claim 1, wherein the detected indication comprises a detected user input.

11. The emissive display of claim 1, wherein the night pixel comprises a red-orange pixel.

12. The emissive display of claim 1, wherein the day pixel comprises a red pixel.

13. An emissive display configured to operate in a day mode and a night mode, the display comprising:

a day pixel configured to operate in the day mode;

a night pixel configured to operate in the night mode, wherein the night pixel is not operational in the day mode;

a common pixel configured to operate in both the day mode and the night mode; and a detector configured to selectively change an operating mode of the emissive display between the day mode and the night mode based on a detected indication;

wherein the night pixel comprises a red-orange pixel.

14. The emissive display of claim 13, wherein the display is an electroluminescent display.

15. The emissive display of claim 13, wherein the display comprises an OLED display.

16. The emissive display of claim 13, wherein the display comprises an LCD display.

17. The emissive display of claim 13, wherein the display comprises an quantum dot display.

18. The emissive display of claim 13, wherein the display comprises a LED display.

19. The emissive display of claim 13, wherein the display comprises a micro-LED display.

20. The emissive display of claim 13, wherein the detected indication comprises a communication from a remote processor.

21. The emissive display of claim 13, wherein the detected indication comprises a detected ambient light condition.

22. The emissive display of claim 13, wherein the detected indication comprises a detected user input.

23. The emissive display of claim 13, wherein the day pixel comprises a red pixel.

* * * * *